US009013120B2

(12) United States Patent
Pierce et al.

(10) Patent No.: US 9,013,120 B2
(45) Date of Patent: Apr. 21, 2015

(54) METHODS FOR DRIVING AN LED LIGHTING DEVICE AND CIRCUITS THEREOF

(71) Applicant: Monolithic Power Systems, Inc., San Jose, CA (US)

(72) Inventors: Jason Pierce, Dahlonega, GA (US); Brent Hughes, Cumming, GA (US)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

(21) Appl. No.: 14/013,541

(22) Filed: Aug. 29, 2013

(65) Prior Publication Data

US 2015/0061543 A1 Mar. 5, 2015

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0845* (2013.01)

(58) Field of Classification Search
None
See application file for complete search history.

(56) References Cited

U.S. PATENT DOCUMENTS

| | | | | |
|---|---|---|---|---|
| 6,791,283 | B2 * | 9/2004 | Bowman et al. | 315/291 |
| 2008/0074869 | A1 * | 3/2008 | Okishima | 362/184 |
| 2013/0241442 | A1 * | 9/2013 | Trattler | 315/307 |

* cited by examiner

*Primary Examiner* — Douglas W Owens
*Assistant Examiner* — Dedei K Hammond
(74) *Attorney, Agent, or Firm* — Perkins Coie LLP

(57) ABSTRACT

A method for driving an LED lighting device includes receiving an input voltage from a battery unit and converting the input voltage into a driving current to drive the LED lighting device. The method further includes detecting whether the battery unit is in a low battery state. When the low battery state of the battery unit is detected, the driving current is reduced.

15 Claims, 4 Drawing Sheets

METHODS FOR DRIVING AN LED LIGHTING DEVICE AND CIRCUITS THEREOF

TECHNICAL FIELD

Embodiments of the present invention relates generally to electronic circuits, and more particularly but not exclusively to LED driving circuits and methods thereof.

BACKGROUND

LED flashlights and headlamps are superior to their incandescent counter parts in many ways, such as the lumen efficacy, the bulb life, the operating temperature and so on. One area where incandescent lights do offer an improvement is a more graceful shutdown as the battery powering them is dying. The light begins to dim and provide the user some warning. However, with an LED flashlight or headlamp, the current is typically regulated by a power converter. The converter provides a constant driving level regardless of the battery's state of charge. This can result in an abrupt shutdown or an operation in a hiccup mode.

SUMMARY

Embodiments of the present invention are directed to a method for driving an LED lighting device. The method comprises receiving an input voltage from a battery unit and converting the input voltage into a driving current to drive the LED lighting device. The method further comprises detecting whether the battery unit is in a low battery state. When the low battery state of the battery unit is detected, the driving current is reduced.

In one embodiment, the step of detecting whether the battery unit is in a low battery state comprises detecting whether the input voltage reaches a predetermined voltage level.

Embodiments of the present invention are also directed to a controller coupled to a power converter. The power converter is configured to receive an input voltage from a battery unit and to provide a driving current to an LED lighting device. The controller comprises a detecting circuit and a controlling circuit. The detecting circuit is configured to detect a low battery state of the battery unit and to generate an indication signal based on the detection. The controlling circuit is configured to receive the indication signal and to provide one or more control signals to the power converter to regulate the driving current based on the indication signal. When the low battery state of the battery unit is detected, the driving current is reduced.

Embodiments of the present invention are further directed to a circuit for driving an LED lighting device. The circuit comprises a power converter, a detecting circuit and a controlling circuit. The power converter is configured to receive an input voltage from a battery unit and to provide a driving current to the LED lighting device. The detecting circuit is configured to detect a low battery state of the battery unit and to generate an indication signal based on the detection. The controlling circuit is configured to receive the indication signal and to provide one or more control signals to the power converter to regulate the driving current based on the indication signal. When the low battery state of the battery unit is detected, the driving current is reduced.

BRIEF DESCRIPTION OF THE DRAWINGS

The present invention can be further understood with reference to the following detailed description and the appended drawings, wherein like elements are provided with like reference numerals.

DETAILED DESCRIPTION

Figure 1:
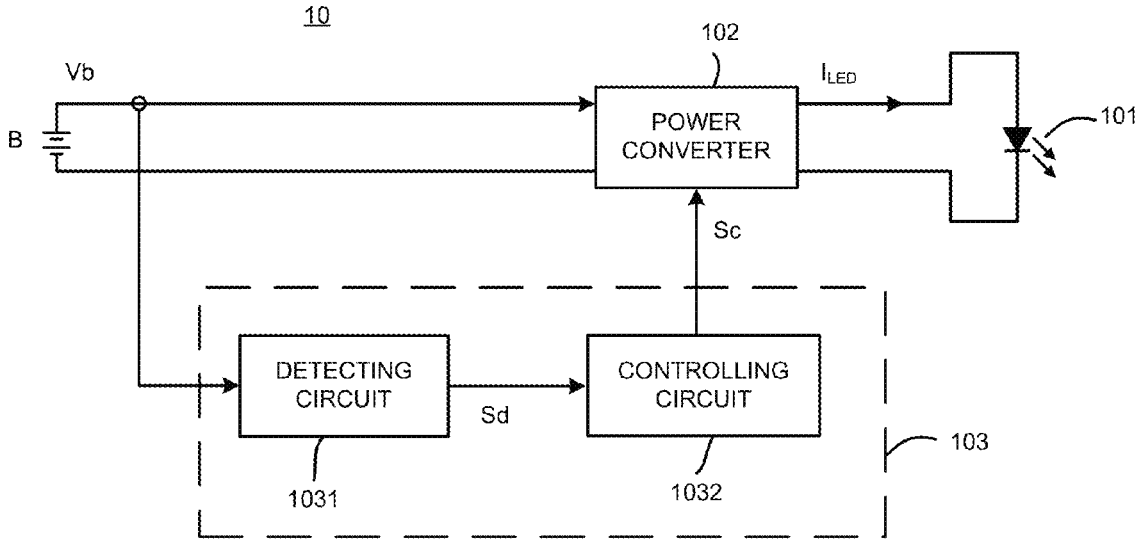
FIG. 1 illustrates a block diagram of an LED driving circuit 10 in accordance with an embodiment of the present invention.

The present invention is now described. While it is disclosed in its preferred form, the specific embodiments of the invention as disclosed herein and illustrated in the drawings are not to be considered in a limiting sense. Rather, these embodiments are provided so that this invention will be thorough and complete, and will fully convey the scope of the invention to those skilled in the art. Indeed, it should be readily apparent in view of the present description that the invention may be modified in numerous ways. Among other things, the present invention may be embodied as devices, methods, software, and so on. Accordingly, the present invention may take the form of an entirely hardware embodiment, an entirely software embodiment or an embodiment combining software and hardware aspects. The following detailed description is, therefore, not to be taken in a limiting sense.

Throughout the specification, the meaning of "a," "an," and "the" may also include plural references.

FIG. 1 illustrates a block diagram of an LED driving circuit 10 in accordance with an embodiment of the present invention. As shown in FIG. 1, the LED driving circuit 10 comprises a power converter 102 and a controller 103. The power converter 102 is coupled to a battery unit B to receive an input voltage Vb and thereby provides a driving current $I_{LED}$ to drive an LED lighting device 101. The controller 103 comprises a detecting circuit 1031 and a controlling circuit 1032. The detecting circuit 1031 is coupled to the battery unit B to detect whether the battery unit B is in a low battery state and thereby generates an indication signal Sd. In an embodiment, the low battery state refers to a state when the power of the battery unit B is less than a certain percentage of its full-charge power, e.g., 10%. The controlling circuit 1032 is coupled to the detecting circuit 1031 to receive the indication signal Sd and thereby provides a control signal Sc based on the indication signal Sd to the power converter 102 to regulate the driving current $I_{LED}$.

In an embodiment, the LED driving circuit 10 may also comprise a feedback circuit. The feedback circuit is coupled to the LED lighting device 101 to sense the driving current $I_{LED}$ and thereby provides a feedback signal to the controlling circuit 1032. The controlling circuit 1032 generates the control signal Sc based on the indication signal Sd and the feedback signal to control the power converter 102.

The battery power decreases gradually as the battery unit B is consumed. When the low battery state of the battery unit B is detected, the controlling circuit 1032 controls the power converter 102 based on the indication signal Sd so that the driving current $I_{LED}$ is reduced. With the decrease of the driving current $I_{LED}$, the LED lighting device 101 dims, which provides the user a warning.

Figure 2:
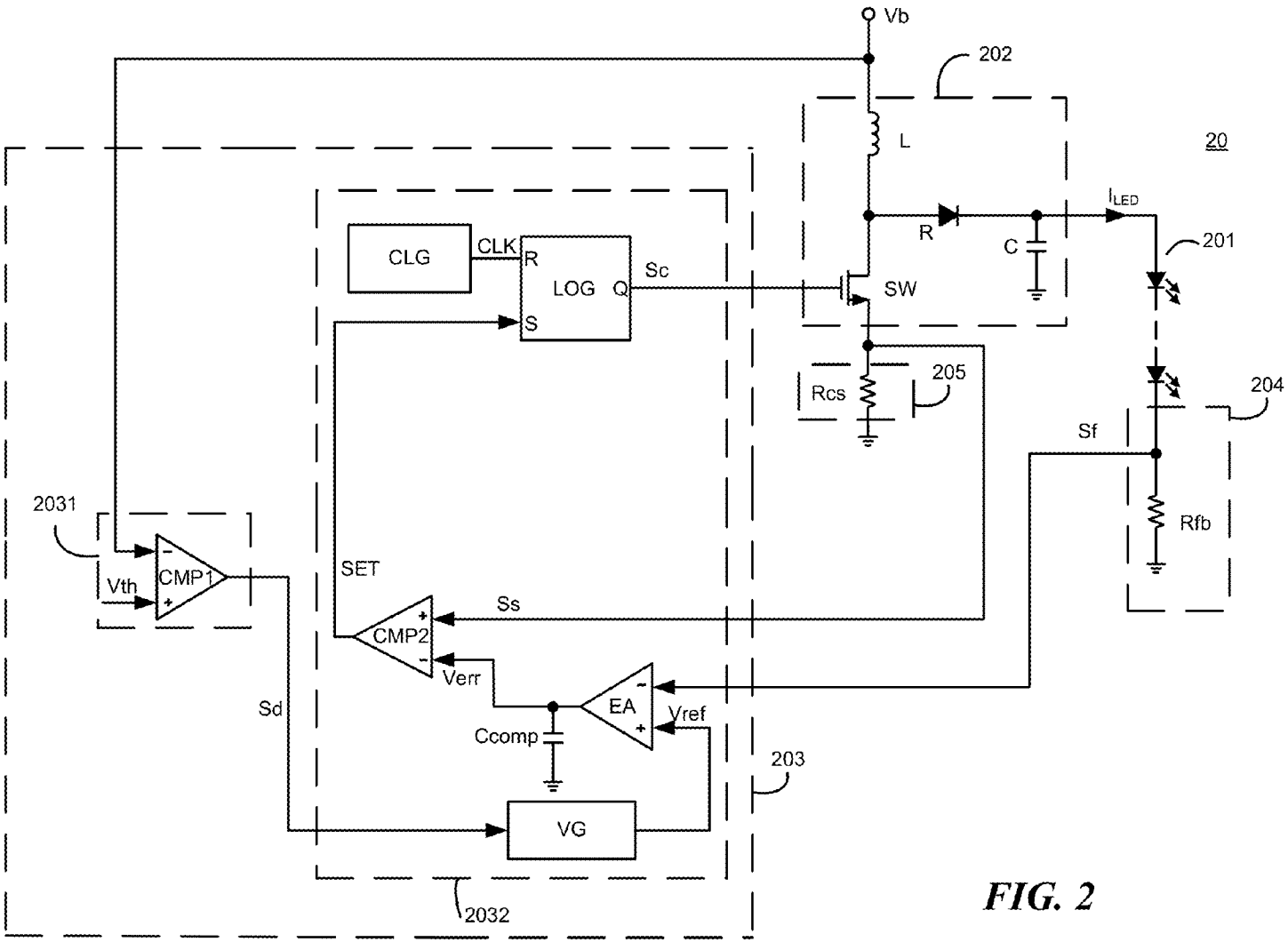
FIG. 2 schematically illustrates an LED driving circuit 20 in accordance with an embodiment of the present invention.

FIG. 2 schematically illustrates an LED driving circuit 20 in accordance with an embodiment of the present invention. As shown in FIG. 2, the LED driving circuit 20 comprises a power converter 202, a controller 203, a feedback circuit 204 and a current sensing circuit 205.

The power converter 202 is configured as a boost converter which comprises a switch SW, a rectifier R, an inductor L and a capacitor C. The inductor L has a first terminal and a second terminal, wherein the first terminal is coupled to a battery unit (not shown) to receive an input voltage Vb. The switch SW has a first terminal, a second terminal and a control terminal, wherein the first terminal is coupled to the second terminal of the inductor L. The rectifier R has an anode terminal and a cathode terminal, wherein the anode terminal is coupled to the second terminal of the inductor L and the first terminal of the switch SW. The capacitor C is coupled between the cathode terminal of the rectifier R and the reference ground. The common node of the rectifier R and the capacitor C is coupled to an LED lighting device 201 to provide a driving current $I_{LED}$.

The feedback circuit 204 senses the driving current $I_{LED}$ flowing through the LED lighting device 201 and outputs a feedback signal Sf. The feedback circuit 204 comprises a feedback resistor Rfb coupled between the LED lighting device 201 and the reference ground. The current sensing circuit 205 senses the current flowing through the inductor L and outputs a current sensing signal Ss. The current sensing circuit 205 comprises a sensing resistor Rcs coupled between the second terminal of the switch SW and the reference ground.

The controller 203 comprises a detecting circuit 2031 and a controlling circuit 2032. The detecting circuit 2031 comprises a comparator CMP1 which respectively receives the input voltage Vb at an inverting terminal and a predetermined voltage level Vth at a non-inverting terminal. The comparator CMP1 compares the input voltage Vb with the predetermined voltage level Vth and generates an indication signal Sd at an output terminal. The controlling circuit 2032 comprises an error amplifier EA, a comparator CMP2, a reference generator VG, a compensation capacitor Ccomp, a clock generator CLG and a logic circuit LOG. The reference generator VG is coupled to the output terminal of the comparator CMP1 to receive the indication signal Sd and accordingly generates a reference signal Vref. The error amplifier EA respectively receives the feedback signal Sf at an inverting terminal and the reference signal Vref at a non-inverting terminal. The error amplifier EA amplifies the difference between the reference signal Vref and the feedback signal Sf and generates an error signal Verr at an output terminal. The error signal Verr is further compensated by a compensation capacitor Ccomp coupled between the output terminal of the error amplifier EA and the reference ground. The comparator CMP2 respectively receives the error signal Verr at a non-inverting terminal and the current sensing signal Ss at an inverting terminal. The comparator CMP2 compares the current sensing signal Ss with the error signal Verr and generates a comparison signal SET. The clock generator CLG generates a clock signal CLK. The logic circuit LOG respectively receives the comparison signal SET at a set terminal and the clock signal CLK at a reset terminal and thereby generates a control signal Sc at an output terminal. The control signal Sc is provided to the control terminal of the switch SW to control the switch SW on/off.

As the battery power is consumed, the input voltage Vb decreases gradually. When the input voltage Vb decreases to the predetermined voltage level Vth, the indication signal Sd generated by the comparator CMP1 is logical high. Accordingly, the reference generator VG reduces the reference signal Vref. As the reference signal Vref is reduced, the error signal Verr decreases and thereby the duty cycle of the control signal Sc decreases. Accordingly, the driving current $I_{LED}$ is reduced.

Persons of ordinary skill in the art will recognize that, in the embodiment illustrated in FIG. 2, the comparator CMP1 is illustrative and should not be taken in a limiting sense. In other embodiments, any other appropriate circuits detecting whether the battery unit is in a low battery state may be used, such as a current detecting circuit.

Persons of ordinary skill in the art will also recognize that a peak current control is utilized in the embodiment illustrated in FIG. 2, however, other control methods may also be applied in other embodiments.

Persons of ordinary skill in the art will also recognize that, the power converter 202 comprises a boost converter in the embodiment of FIG. 2, however, other switching converters, such as step-down converter, flyback converter or the like may also be utilized in other embodiments. The LED driving circuit may utilize a LDO to regulate the driving current too.

Persons of ordinary skill in the art will also recognize that, in the embodiment illustrated in FIG. 2, an analog dimming method is utilized to control the driving current, however, in other embodiments, PWM dimming may also be utilized. In PWM dimming circuits, a switch controlled by a dimming signal is serially coupled to the LED lighting device. The duty cycle of the dimming signal is adjusted according to the indication signal Sd, and when a low battery state of the battery unit is detected, the duty cycle is reduced. As a result, the equivalent driving current is reduced.

Figure 3A:
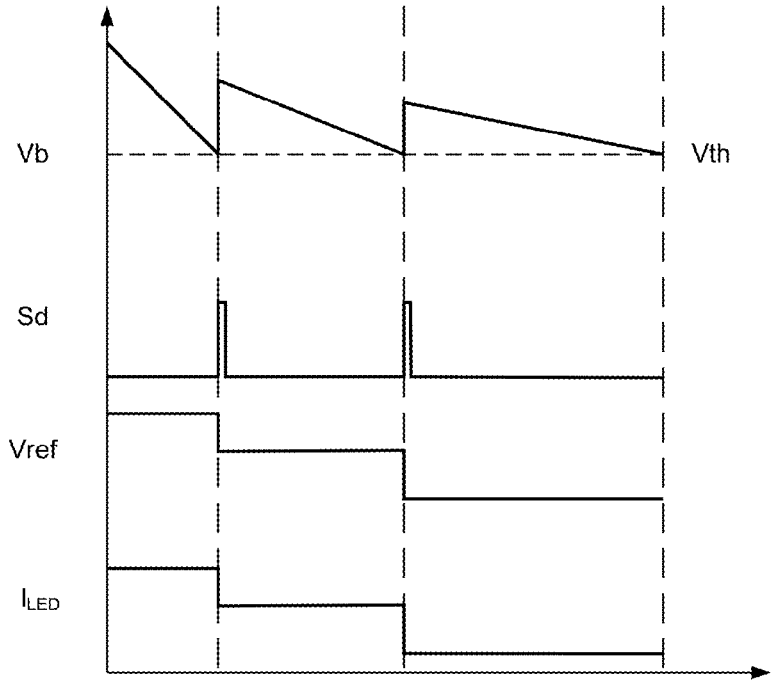
FIGS. 3(*a*)-3(*c*) show a series of waveforms illustrating the operation of the LED driving circuit 20 of FIG. 2.
Figure 3B:
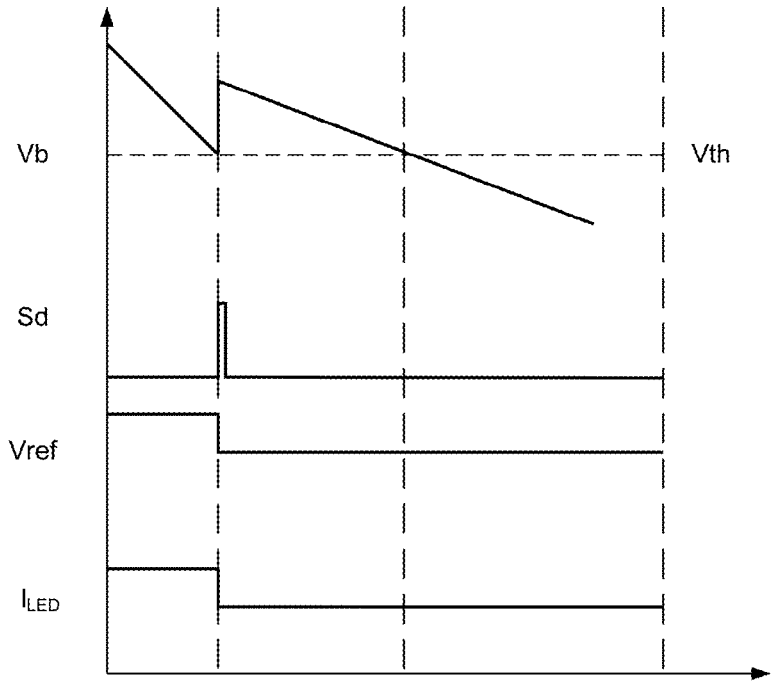
Figure 3C:
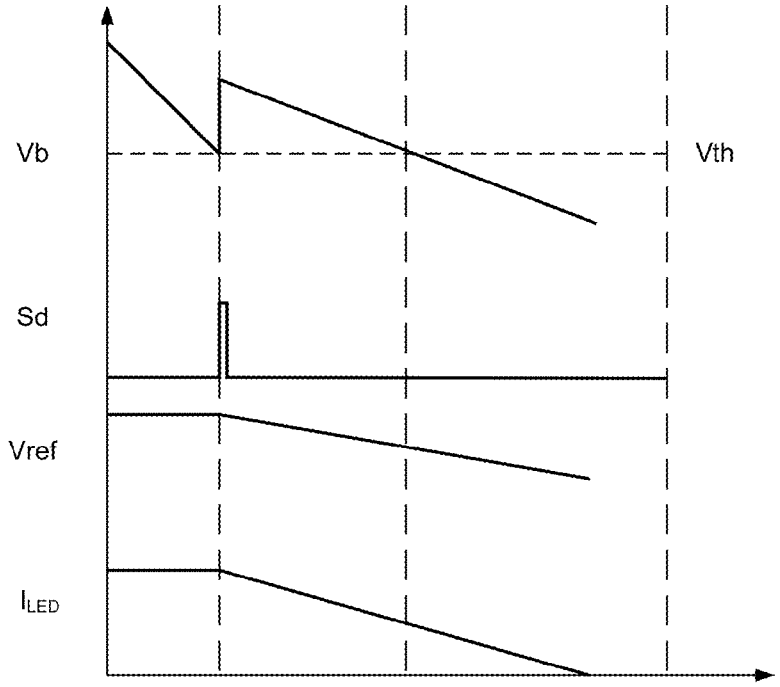

FIGS. 3(*a*)-3(*c*) show a series of waveforms illustrating the operation of the LED driving circuit 20 of FIG. 2. The waveforms from top to bottom respectively represent the input voltage Vb, the indication signal Sd, the reference signal Vref and the driving current $I_{LED}$.

In the embodiment illustrated in FIG. 3(*a*), each time the input voltage Vb reaches the predetermined voltage level Vth, the indication signal Sd changes from low level to high level such that the reference generator VG outputs a reference signal which is lower than the previous one, and the reference signal is maintained until the input voltage Vb reaches the predetermined voltage level Vth again.

In the embodiment illustrated in FIG. 3(*b*), the driving current is reduced when the input voltage Vb reaches the predetermined voltage level Vth, and is maintained constant until the battery unit dies.

In the embodiment illustrated in FIG. 3(*c*), the driving current $I_{LED}$ is continuously reduced once the input voltage Vb decreases to the predetermined voltage level Vth.

As an example, a single lithium ion cell (18650 size) for LED flashlights and headlamps is tested. The predetermined voltage level Vth is set at 3V and the cell is initially discharged at 1000 mA. If the 1000 mA discharge current is continued as in the prior arts, the cell would have been completely dead very shortly. However, in accordance with the embodiments of the present invention, the cell takes 1.84 hours to reach the predetermined voltage level of 3V. The cell is then discharged at 100 mA until it again hits 3V. This segment of discharge takes 1.37 hours. Thus, a light configured in such a manner can provide a full brightness for 1.84 hours and then an additional 1.37 hours of useable light for the user to safely react. Besides, an additional segment of 1% brightness, that is, the cell is discharged at 10 mA, is also tested and an additional 5.43 hours is taken to reach 3V again.

As another example, a battery unit of three series 900 mAH AAA NiMH cells is tested in a similar manner as described above. The predetermined voltage level is still chosen to be 3V, and the discharge currents are respectively set to be 450 mA, 45 mA and 4.5 mA per segment. As a result, the times to reach 3V in each segment are respectively 1.59, 2.5 and 20 hours. Thus, the light can run at full brightness of 1.59 hours and then an additional 2.5 hours at 10% brightness and an additional 20 hours at 1% brightness.

As a result, the light dims when the battery unit is in the low battery state, and an additional useable time is provided for the user to safely react. Therefore, the LED driving circuit in accordance with the embodiments of the present invention offers an improvement with a more graceful shutdown.

Figure 4:
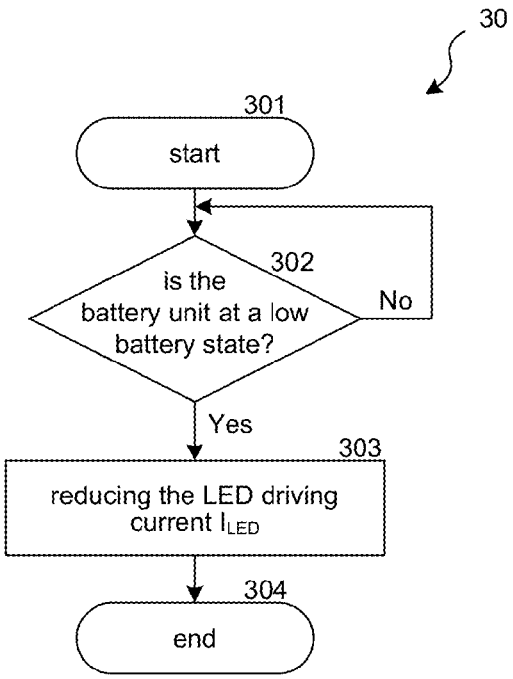
FIG. 4 illustrates a flow chart of an LED driving method 30 in accordance with an embodiment of the present invention.

FIG. 4 illustrates a flow chart of an LED driving method 30 in accordance with an embodiment of the present invention. Referring now to FIG. 4, the LED driving method 30 comprises steps 301 to 304. In step 301, an input voltage Vb is received from a battery unit and further converted into a driving current $I_{LED}$ to drive an LED lighting device. In the following step 302, a low battery state of the battery unit is detected. If the low battery state is detected, the procedure then jumps to step 303, otherwise back to step 302. In step 303, the LED driving current $I_{LED}$ is reduced.

In an embodiment, the step 302 may comprise detecting whether the input voltage Vb decreases to a predetermined voltage level. However, persons of ordinary skill in the art would recognize that, in other embodiments, the step of detecting whether the battery unit is in a low battery state may be achieved by any other appropriate techniques, such as a current detection.

Moreover, in step 303 of an embodiment, the LED driving current $I_{LED}$ may be reduced in a plurality of steps. During each step, the driving current $I_{LED}$ is reduced by a preset value. In an embodiment, the preset values of the plurality of steps may be different. The driving current $I_{LED}$ is reduced by a next step of the plurality of steps only when the input voltage Vb reaches the predetermined voltage level. Furthermore, in step 303 of an embodiment, during each of the plurality of steps, the LED driving current $I_{LED}$ may be reduced by the preset value and then maintained until the next step of the plurality of steps.

While in step 303 of another embodiment, the LED driving current $I_{LED}$ may be reduced to a first current level when the low battery state of the battery unit is detected, and the LED driving current is maintained at the first current level until the battery unit dies.

While in step 303 of another embodiment, the LED driving current $I_{LED}$ may be continuously reduced.

Persons of ordinary skill in the art will recognize that, in the embodiments illustrated in FIGS. 1-4, the LED lighting device may comprise one single LED, a string of LEDs or a plurality of LED strings. And the present invention may be applied not only in flashlight and headlamp applications, but also in other LED lighting devices powered by a battery unit.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

We claim:

1. A method for driving an LED lighting device, comprising:

receiving an input voltage from a battery unit;

converting the input voltage into a driving current to drive the LED lighting device;

detecting whether the battery unit is in a low battery state; and reducing the driving current when the low battery state of the battery unit is detected, wherein the driving current is reduced in a plurality of steps, and the driving current is reduced by a preset value during each of the plurality of steps.

2. The method of claim 1, wherein the step of detecting whether the battery unit is in a low battery state comprises detecting whether the input voltage reaches a predetermined voltage level.

3. The method of claim 2, wherein the driving current is reduced by a next step of the plurality of steps only when the input voltage reaches the predetermined voltage level.

4. The method of claim 3, wherein during each of the plurality of steps, the driving current is reduced by the preset value and is then maintained until the next step of the plurality of steps.

5. The method of claim 1, wherein the LED lighting device is a flashlight or a headlamp.

6. A controller coupled to a power converter, wherein the power converter is configured to receive an input voltage from a battery unit and to provide a driving current to an LED lighting device, wherein the controller comprises:

a detecting circuit configured to detect a low battery state of the battery unit and to generate an indication signal based on the detection; and a controlling circuit configured to receive the indication signal and to provide one or more control signals to the power converter to regulate the driving current based on the indication signal;

wherein the driving current is reduced when the low battery state of the battery unit is detected, wherein the driving current is reduced in a plurality of steps, and the driving current is reduced by a preset value during each of the plurality of steps.

7. The controller of claim 6, wherein the controlling circuit comprises:

a reference generator configured to receive the indication signal and to generate a reference signal based on the indication signal;

an error amplifier having a first input terminal, a second input terminal and an output terminal, wherein the first input terminal is coupled to the reference generator to receive the reference signal, the second input terminal is configured to receive a feedback signal indicating the current flowing through the LED lighting device, and wherein the error amplifier amplifies the difference between the reference signal and the feedback signal, and generates an error signal at the output terminal;

a comparator having a first input terminal, a second input terminal and an output terminal, wherein the first input terminal is coupled to the output terminal of the error amplifier to receive the error signal, the second input terminal is configured to receive a current sensing signal, the comparator compares the reference signal with the current sensing signal and generates a comparison signal;

a clock generator configured to generate a clock signal; and a logic circuit having a first input terminal, a second input terminal and an output terminal, wherein the first input terminal is coupled to the output terminal of the comparator to receive the comparison signal, the second terminal is coupled to the clock generator to receive the clock signal, wherein the logic circuit generates the one or more control signals based on the comparison signal and the clock signal.

8. The controller of claim 6, wherein the detecting circuit comprises a comparator having a first input terminal, a second input terminal and an output terminal, and wherein the first input terminal is configured to receive the input voltage, the second input terminal is configured to receive a predetermined voltage level, the comparator compares the input voltage with the predetermined voltage level and generates the indication signal at the output terminal.

9. The controller of claim 8, wherein the driving current is reduced by a next step of the plurality of steps only when the input voltage reaches the predetermined voltage level.

10. The controller of claim 9, wherein during each of the plurality of steps, the driving current is reduced by the preset value and is then maintained until the next step of the plurality of steps.

11. A circuit for driving an LED lighting device, comprising:

a power converter configured to receive an input voltage from a battery unit and to provide a driving current to the LED lighting device;

a detecting circuit configured to detect a low battery state of the battery unit and to generate an indication signal based on the detection; and a controlling circuit configured to receive the indication signal and to provide one or more control signals to the power converter to regulate the driving current based on the indication signal;

wherein the driving current is reduced when the low battery state of the battery unit is detected, and wherein the controlling circuit comprises:

a reference generator configured to receive the indication signal and to generate a reference signal based on the indication signal;

an error amplifier having a first input terminal, a second input terminal and an output terminal, wherein the first input terminal is coupled to the reference generator to receive the reference signal, the second input terminal is configured to receive a feedback signal indicating the current flowing through the LED lighting device, and wherein the error amplifier amplifies the difference between the reference signal and the feedback signal, and generates an error signal at the output terminal;

a comparator having a first input terminal, a second input terminal and an output terminal, wherein the first input terminal is coupled to the output terminal of the error amplifier to receive the error signal, the second input terminal is configured to receive a current sensing signal, the comparator compares the reference signal with the current sensing signal and generates a comparison signal;

a clock generator configured to generate a clock signal; and a logic circuit having a first input terminal, a second input terminal and an output terminal, wherein the first input terminal is coupled to the output terminal of the comparator to receive the comparison signal, the second terminal is coupled to the clock generator to receive the clock signal, wherein the logic circuit generates the one or more control signals based on the comparison signal and the clock signal.

12. The circuit of claim 11, wherein the detecting circuit comprises a comparator having a first input terminal, a second input terminal and an output terminal, and wherein the first input terminal is configured to receive the input voltage, the second input terminal is configured to receive a predetermined voltage level, the comparator compares the input voltage with the predetermined voltage level and generates the indication signal at the output terminal.

13. The circuit of claim 12, wherein the driving current is reduced in a plurality of steps, and wherein the driving current is reduced by a preset value during each of the plurality of steps, and the driving current is reduced by a next step of the plurality of steps only when the input voltage reaches the predetermined voltage level.

14. The circuit of claim 13, wherein during each of the plurality of steps, the driving current is reduced by the preset value and is then maintained until the next step of the plurality of steps.

15. The circuit of claim 11, wherein the driving current is reduced to a first current level when the low battery state of the battery unit is detected, and the driving current is maintained at the first current level until the battery unit dies.

* * * * *